United States Patent [19]

Maloof

[11] 3,963,291

[45] June 15, 1976

[54] SWIVEL ELECTRICAL CONNECTOR

[75] Inventor: Robert Edward Maloof, East Greenwich, R.I.

[73] Assignee: Victor Electric Wire & Cable Corporation, West Warwick, R.I.

[22] Filed: Aug. 4, 1975

[21] Appl. No.: 601,712

[52] U.S. Cl. ..... 339/8 P; 339/182 RS

[51] Int. Cl.[2] ..... H01R 39/00

[58] Field of Search ..... 339/8 P, 8 R, 101 X, 339/182 RS, 88 R, 90 R

[56] References Cited

UNITED STATES PATENTS 1,492,532 4/1924 Phillips ..... 339/182 RS X 2,387,015 10/1945 Gilbertson ..... 339/8 P

*Primary Examiner*—Roy Lake
*Assistant Examiner*—DeWalden W. Jones
*Attorney, Agent, or Firm*—Salter & Michaelson

[57] ABSTRACT

A swivel electrical connector having an internal socket conductor for receiving a male plug therein and having an external conductor for receiving a spring contact in engagement therewith, the internal socket conductor and the external conductor being formed of concentric eyelets and encapsulated in a plastic body, the entire connector being constructed without the requirement of screw machine parts.

6 Claims, 3 Drawing Figures

SWIVEL ELECTRICAL CONNECTOR

Background of the Invention

The present invention relates to a swivel electrical connector for use with a small electrical appliance and is of the type that includes a female conductor that receives a male plug therein, the electrical connector being swivally rotatable with the power supply cord as a unit.

In many small electrical appliances, male plugs are provided that are used in conjunction with a spring contact for receiving an electrical connector that supplies the operating current to the appliance. Oftentimes, in use, the appliance is manipulated in a manner that causes the power supply cord interconnected thereto to become snarled or tangled in a manner that restricts the use of the appliance. Prior to the instant invention, swivel electrical connectors for use with power supply cords for appliances have sometimes been constructed in a manner to avoid the snarling or tangling of the power supply cord, but such constructions have necessarily included a number of screw machine parts that have not only complicated the manufacture and assembly of the electrical connector, but have also prohibitively increased the cost thereof.

SUMMARY OF THE INVENTION

The present invention includes a swivel electrical connector of extremely simple construction that is provided with a tubular external conductor in which a tubular internal conductor is received in coaxial relation with respect thereto. The tubular conductors are spaced apart sufficiently to provide for the introduction of an insulating material therebetween, the insulating material being formed as part of a body that encapsulates conducting leads that are electrically connected to the conductors. The entire swivel electrical connector is formed without the use of screw machine parts and basically includes only the two tubular conductors that define the electrical circuits that extend through the electrical connector. In use, the internal conductor receives a male prong therein and is swivally movable thereabout, whereas the external conductor is located so as to be continuously engaged by a spring contact during the movement of the connector.

Accordingly, it is an object of the present invention to provide a swivel electrical connector, the conductors of which are a tubular external conductor and a tubular internal conductor located interiorly of the external conductor and insulated therefrom, the internal conductor receiving a male plug therein to provide for swivel movement of the electrical connector thereabout.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carring out the present invention.

DESCRIPTION OF THE INVENTION

Figure 1:
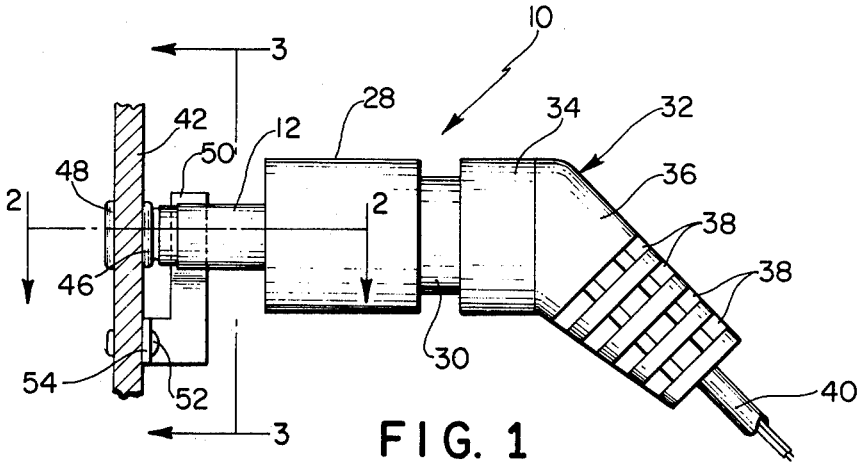
FIG. 1 is a side elevational view of the electrical connector embodied herein, the connector being shown in electrical communication with contacts as mounted on a base member.
Figure 2:
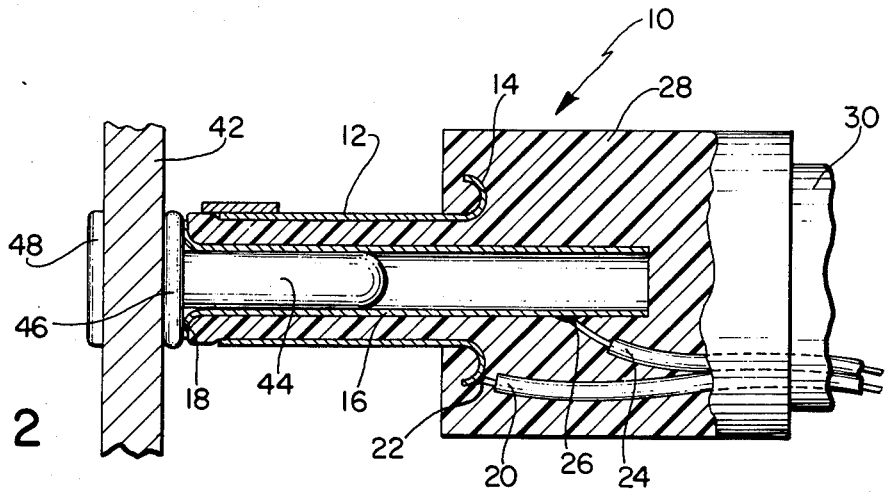
FIG. 2 is a sectional view taken along line 2—2 in FIG. 1.

Referring now to the drawing and particularly to FIGS. 1 and 2, the swivel electrical connector embodied in the present invention is illustrated and is generally indicated at 10. As shown, the swivel electrical connector 10 is adapted for use with small electrical appliances, particularly of the hand-held variety. In this connection, the swivel electrical connector 10 is formed with a female socket for receiving a male contact plug, and as will be described, is swivally movable about the male plug while remaining in electrical contact therewith.

Referring now to FIG. 2 in particular, the swivel electrical connector 10 includes a tubular external conductor 12 that is formed with an arcuate shaped interior flange 14 on the rear end thereof. Located interiorly of the external conductor 12 and disposed in spaced, coaxial relation therewith is an interior conductor 16 on the outermost end of which a flared contact flanged 18 is formed. As shown in FIG. 2, the contact flange 18 is spaced outwardly from the outermost edge of the external conductor 12; and, as will be described, this spacing between the conductors is filled with a molded insulating plastic material in the final assembly of the connector.

As illustrated and described, the connector 10 as constructed is devoid of any screw machine parts, and essentially consists of the external conductor 12 and the internal conductor 16. Each of these conductors define one side of an electrical circuit through the connector 10, an electrical lead 20 being joined to the flange 14 of the external conductor 12 at a solder connection 22, and an electrical lead 24 being joined to the internal conductor at a solder connection 26.

The swivel connector 10 is molded as an integral one-piece construction to positively position and locate the external and internal conductors 12 and 16 relative to each other and to further encapsulate the connections of the electrical leads 20 and 24 therein. For this purpose a suitable plastic material is molded in the form as illustrated in the drawing to define a forward portion 28, a central reduced portion 30 and a rear portion generally indicated at 32 that has a goose neck configuration defined by a section 34 that is located in coaxial relation with respect to the forward portion 28, and the reduced neck section 30, and a handle section 36 that is angularly disposed with respect to the section 34. As illustrated in FIG. 1, the handle section 36 is formed with a plurality of slots 38 that define strain relief areas for the leads 20 and 24 that are encased in insulation 40 that extends into the connector.

Referring again to FIG. 2, it is seen that when the forward portion 28 of the connector is molded in the configuration as illustrated, the plastic material enters the space between the external conductor 12 and the internal conductor 16 to insulate the conductors from each other, the insulating plastic material also extending forwardly of the conductor 12 to space the outermost edge of the conductor 12 from the flared contact flange 18 of the internal conductor 16.

Figure 3:
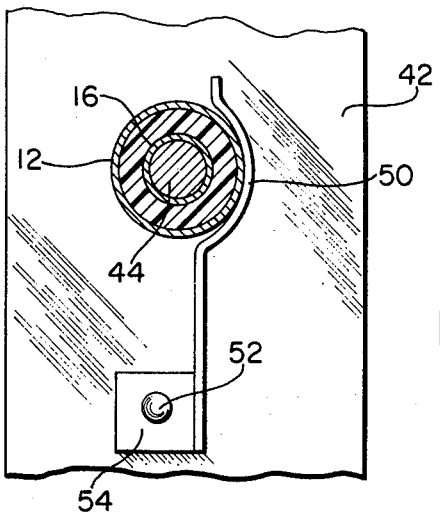
FIG. 3 is a sectional view taken along line 3—3 in FIG. 1.

In the final molded form of the connector 10, the external conductor 12 projects outwardly beyond the forwardmost end of the forward portion 28 and is exposed for engagement by a spring contact, while the internal conductor 16 which extends outwardly beyond the outermost edge of the external conductor 12 is suitably located for receiving a male contact therein, the flared flange 18 providing a lead-in for the male contact. Referring again to FIG. 1 of the drawing, the electrical connector 10 is shown in the position in which it has been mounted for establishing electrical communication through an appliance or the like. In this connection, an interior terminal board of the appliance is indicated at 42 and mounted thereon is a male contact defined by a plug 44 that is secured in position in the wall 42 by opposed flanges 46 and 48 of the grommet-type connection. The connector 10 is preferably mounted on a wall (not shown) of the appliance, wherein the reduced neck section 30 is received in a suitable opening in the wall. Although not shown, an electrical lead is adapted to be interconnected to the male prong 44 by securement to the flange 48 in any conventional manner. Also mounted on the interior terminal board 42 is a spring contact 50, the spring contact being secured to the wall 42 by a rivet 52 that extends through a flange 54. The spring contact 50 is also electrically connected to a suitable conducting wire (not shown) that engages the flange 54, and as more clearly illustrated in FIGS. 2 and 3, the spring contact 50 includes a curved portion that is maintained in permanent wiping engagement with the circular outer conductor 12 and establishes electrical communication therebetween.

It is also contemplated to substitute a standard female tubular contact for the internal conductor 16, wherein the flared contact flange 18 is eliminated and a crimpable tail piece is provided. In this event the electrical lead 24 is secured to the tubular contact by crimping the tail piece over an exposed portion of the lead 24.

As mounted on the male plug 44 and in engagement with the spring contact 50, the connector 10 is swivally movable relative thereto. Thus, the internal conductor 16 is rotatable relative to the male prong 44, the remaining portions of the electrical connector 10 being rotatable as a unit relative to the male prong 44 in a swivel-like movement. It is understood that when the appliance with which the connector 10 is used is placed in operation 360° rotation of the electrical connector 10 effectively eliminates any snarling or tangling of the power cord associated with the connector. In particular, when the electrical appliance to which the connector is affixed is of a hand-held type and requires considerable movement, any rotating movement of the electrical connector 10 with respect to the male plug 44 cannot result in any snarling or kinking of the power cord. The engagement of the electrical contacts 44 and 50 with the internal and external conductors, respectively, is maintained in a positive manner regardless of the position of the swivel electrical connector, thereby insuring trouble-free operation of the appliance with which the connector is used, and further insuring that power is continuously supplied to the motor thereof.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A swivel electrical connector comprising a tubular external conductor, a tubular internal conductor located internally of said external conductor in coaxial relation with respect thereto, an insulating material separating the conductors so that each forms part of a separate electrical circuit, a first conducting lead joined to said external conductor, a second conducting lead joined to said internal conductor, the insulating material defining a body that encapsulates the connections of said conducting leads to said conductors therein, said tubular internal conductor defining a socket for receiving a male conductor prong therein and said external conductor being exposed for engagement by a spring contact, wherein said body and conductors mounted thereon are swivally movable about the male prong as received in said internal conductor, said spring contact being maintained in continuous contact with said external conductor during the swivel movement thereof.

2. A swivel electrical connector as claimed in claim 1, said tubular external connector being foreshortened at least at the outer end thereof relative to the adjacent end of said internal conductor, said insulating material insulating the outer ends of said internal conductor from the outer end of said external conductor.

3. A swivel electrical connector as claimed in claim 1, the outermost end of said internal conductor having a flared configuration to provide a lead-in for said male prong.

4. A swivel electrical connector as claimed in claim 1, said body including a forward portion in which the connections of said conducting leads to said conductors are encapsulated, and a rear portion being integrally molded with said forward portion and having a section the axis of which is angularly disposed relative to said forward portion, thereby providing for easy handling of said connector.

5. A swivel electrical connector as claimed in claim 1, said internal and external conductors being defined as annular sleeves, the length of the internal conductor being greater than the length of said external conductor.

6. A swivel electrical connector as claimed in claim 5, the diameter of said external conductor being sufficiently greater than the diameter of said internal conductor to define a space therebetween in which the insulating material is received to insulate the conductors from each other.

* * * * *